United States Patent [19]

Mori

[11] 4,415,271

[45] Nov. 15, 1983

[54] COMPACT ELECTRONIC DEVICE HAVING CALENDAR FUNCTION

[75] Inventor: Hiromitsu Mori, Kodaira, Japan

[73] Assignee: Casio Computer Co., Ltd., Tokyo, Japan

[21] Appl. No.: 268,796

[22] Filed: Jun. 1, 1981

[30] Foreign Application Priority Data

Jun. 6, 1980 [JP] Japan ..... 55-76330
Jun. 6, 1980 [JP] Japan ..... 55-76331
Jun. 6, 1980 [JP] Japan ..... 55-76332

[51] Int. Cl.[3] ..... G09G 3/00; G04F 8/00; G04B 47/00

[52] U.S. Cl. ..... 368/41; 368/10; 368/28

[58] Field of Search ..... 368/10, 28, 29, 30, 368/31, 41, 82

[56] References Cited

U.S. PATENT DOCUMENTS 4,086,655 4/1978 Tanimoto et al. ..... 368/10 X
4,093,992 6/1978 Kawamura et al. ..... 368/10 X
4,100,401 7/1978 Tutt et al. ..... 368/10 X
4,101,963 7/1978 Reese et al. ..... 368/10 X
4,152,768 5/1979 Kuriya ..... 368/10 X
4,162,610 7/1979 Levine ..... 368/10 X
4,164,038 8/1979 Nachtigal ..... 368/10 X
4,206,458 6/1980 Sado ..... 368/10 X
4,214,433 7/1980 Terao ..... 368/28
4,216,649 8/1980 Ichikawa et al. ..... 368/10 X
4,224,789 9/1980 Sasaki et al. ..... 368/28 X
4,240,150 12/1980 Ebihara et al. ..... 368/10 X
4,247,925 1/1981 Meshi et al. ..... 368/10 X
4,274,146 6/1981 Yanagawa ..... 368/30 X
4,276,628 6/1981 Nomura ..... 368/28 X
4,303,995 12/1981 Aizawa ..... 368/28
4,308,608 12/1981 Uga ..... 368/30 X
4,335,453 6/1982 Fatton ..... 368/30
4,353,178 10/1982 Maczawa ..... 368/30 X
4,362,392 12/1982 Kumata ..... 368/41 X
4,385,291 5/1983 Piguet ..... 368/41 X

*Primary Examiner*—J. V. Truhe
*Assistant Examiner*—Terry Flower
*Attorney, Agent, or Firm*—Frishauf, Holtz, Goodman and Woodward

[57] ABSTRACT

A compact electronic device having a calendar function wherein initial data for setting a plurality of specified dates and setting data for setting a plurality of specified dates based on the initial data are input by a key input section. Then, dates to be set as specified dates are calculated by a RAM, a control section and an operation circuit according to the input initial and setting data. The calculated dates are stored in a memory so that the plurality of specified dates may be set.

8 Claims, 20 Drawing Figures

COMPACT ELECTRONIC DEVICE HAVING CALENDAR FUNCTION

BACKGROUND OF THE INVENTION

The present invention relates to a compact electronic device having a calendar function wherein a plurality of specified dates such as holidays, schedules and so on may be set by simple key operations.

Compact electronic computers are conventionally known which have a calendar function wherein the calendar of a particular month of a particular year may be displayed. In one such compact electronic computer having a calendar function, specific dates such as anniversaries and holidays of companies are designated and stored in advance, and a separate display next to the general display is lit for the specific dates during the calendar display. However, according to the conventional method of setting the specified dates, the date data must be input separately for each specific date. Therefore, even when setting the same dates of each month or the same days of each week such as holidays of a store or the like, these dates and days must be separately set for each month or week. Further, for setting the specified dates of a long period of time such as a summer vacation, entering operations must be performed for all the days during this period, resulting in many operations.

It is an object of the present invention to provide a compact electronic device having a calendar function wherein a plurality of specified dates may be set by simple key operations for inputting initial data as a reference for setting a plurality of specified dates and setting data representing what specified dates are set, instead of setting a plurality of specified dates by performing separate key operations for each date.

SUMMARY OF THE INVENTION

In order to achieve this object, there is provided according to the present invention a compact electronic device having a calendar function comprising:

key input means having keys for setting initial data as a reference for setting a plurality of specified dates, keys for inputting setting data for setting a plurality of specified dates based on said initial data, and keys for setting a plurality of dates according to said initial data and said setting data;

temporary memory means for storing said initial data and said setting data input by said key input means;

specified date calculating means for calculating a specified date according to the forms of said initial data and said setting data;

date memory means for storing a plurality of dates calculated by said specified date calculating means; and visual display means for displaying a plurality of dates stored in said date memory means.

According to this construction of the present invention, consecutive dates such as one particular week of a particular month of a particular year or a period of a predetermined number of days from a particular day, month, and year may be set by simple key operations. Further, a particular day of the week from January through December of a year may also be set by simple key operations. Erroneous setting of dates may also be prevented due to the simplicity of the operations.

This invention can be more fully understood from the following detailed description when taken in conjunction with the accompanying drawings.

DETAILED DESCRIPTION

Figure 1:
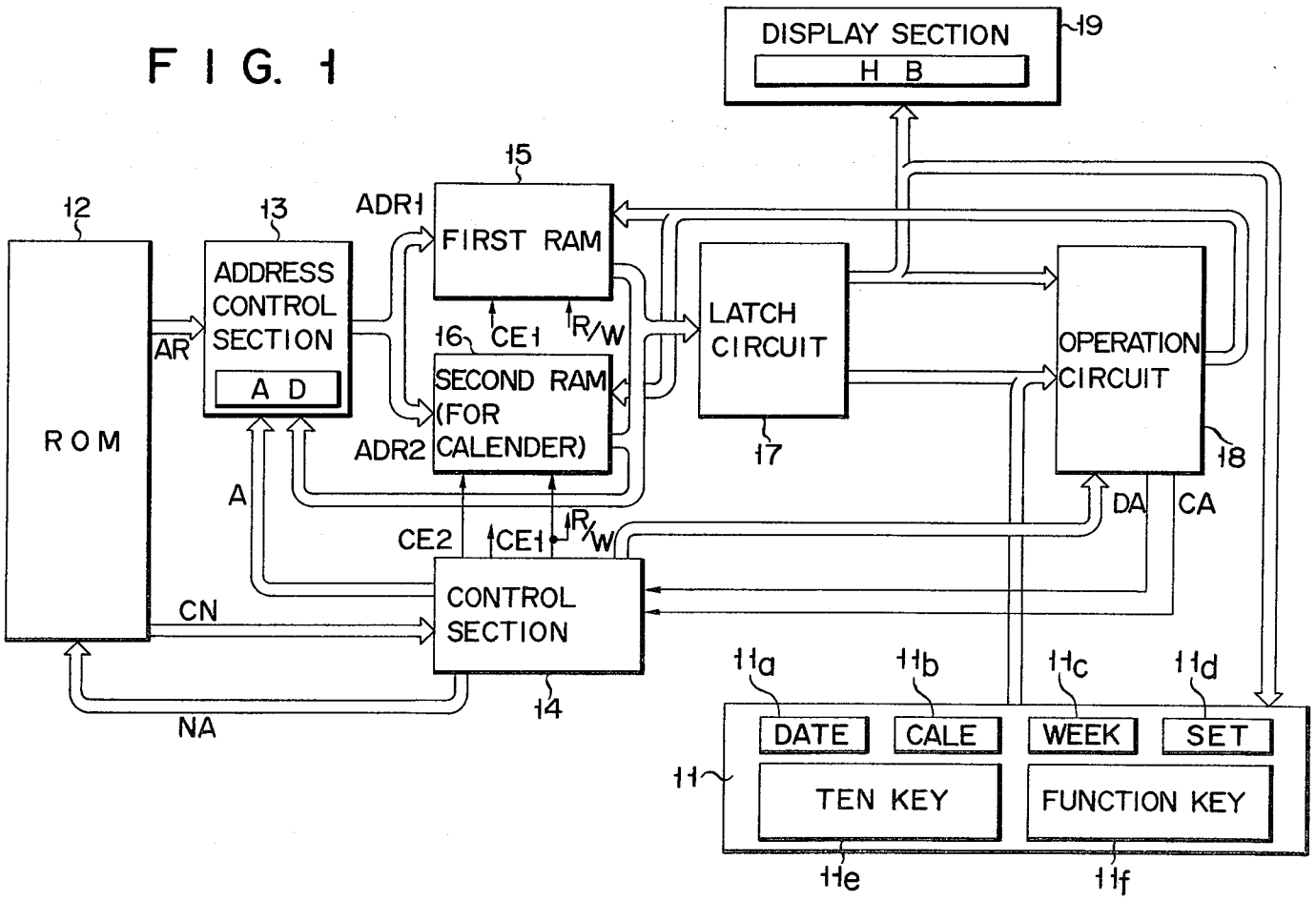
FIG. 1 is a block circuit diagram showing an embodiment of the present invention applied to a compact electronic device having a calendar function.

Preferred embodiments of the present invention will now be described with reference to the accompanying drawings. FIG. 1 shows the system configuration of a compact electronic computer having a calendar function. Referring to this figure, reference numeral 11 denotes a key input section which has a "DATE" key 11*a* for inputting data on year, month, and date; a "CALE" key 11*b* for displaying a calendar; a "WEEK" key 11*c* for inputting data on the week; a "SET" key 11*d* for setting a specified date; a ten key section 11*e*; and a function key section 11*f*. Reference numeral 12 denotes a ROM (read only memory) for storing various kinds of microinstructions, from which an address control signal AR is supplied to an address control section 13 and a control signal CN is supplied to a control section 14.

The address control section 13 supplies address designating signals ADR1 and ADR2 to a first RAM 15 and a second RAM 16. The first RAM 15 and the second RAM 16 supply output signals to a latch circuit 17 and the address control section 13. The data held at the latch circuit 17 is supplied to an operation circuit 18 where an operation is performed according to an operation designating signal output from the control section 14. The operation circuit 18 supplies the operation result to the first RAM 15 and the second RAM 16. The operation circuit 18 supplies a carry signal CA and a data signal DA to the control section 14. The control section 14 outputs a next address designating signal of the ROM 12 according to these signals. A control signal A of an address register AD is supplied from the control section 14 to the address control section 13. The control section 14 supplies selection signals CE1 and CE2 as well as a read/write signal R/W to the first RAM 15 and the second RAM 16, respectively. The data supplied from the key input section 11 is input through the operation circuit 18 to a T register of the first RAM 15, to be described later. The latch circuit 17 is connected to a display section 19 having a display buffer HB and to the key input section 11 through a data bus.

Figure 2:
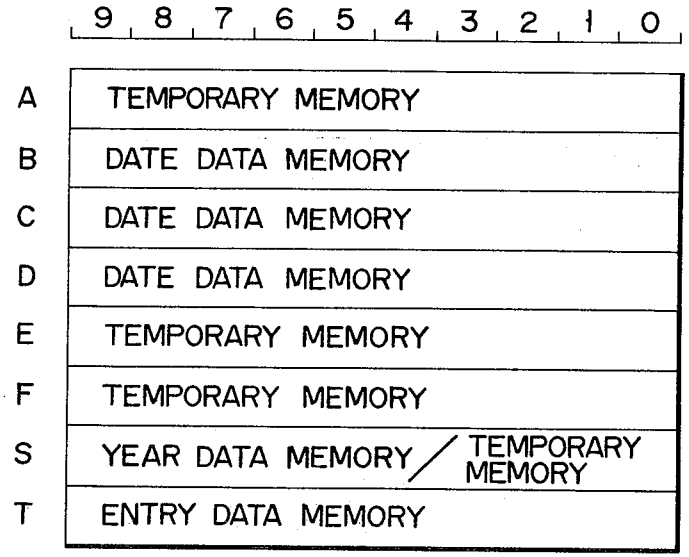
FIG. 2 is a view showing the arrangement of registers included in a first RAM 15 shown in FIG. 1.

FIG. 2 shows the construction of the first RAM 15 shown in FIG. 1. As shown in FIG. 2, the first RAM 15 has, in addition to X, Y and Z operation registers (not shown), A to F registers, and S and T registers. The A, E and F registers are for temporary memory, the B to D registers are for date data memory, the S register is for year data memory or temporary memory, and the T register is for entry data memory.

Figure 3:
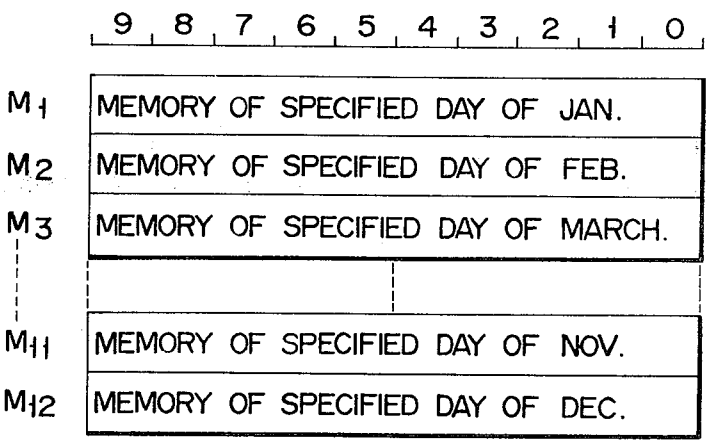
FIG. 3 is a view showing the arrangement of registers included in a second RAM 16 shown in FIG. 1.
Figure 4:
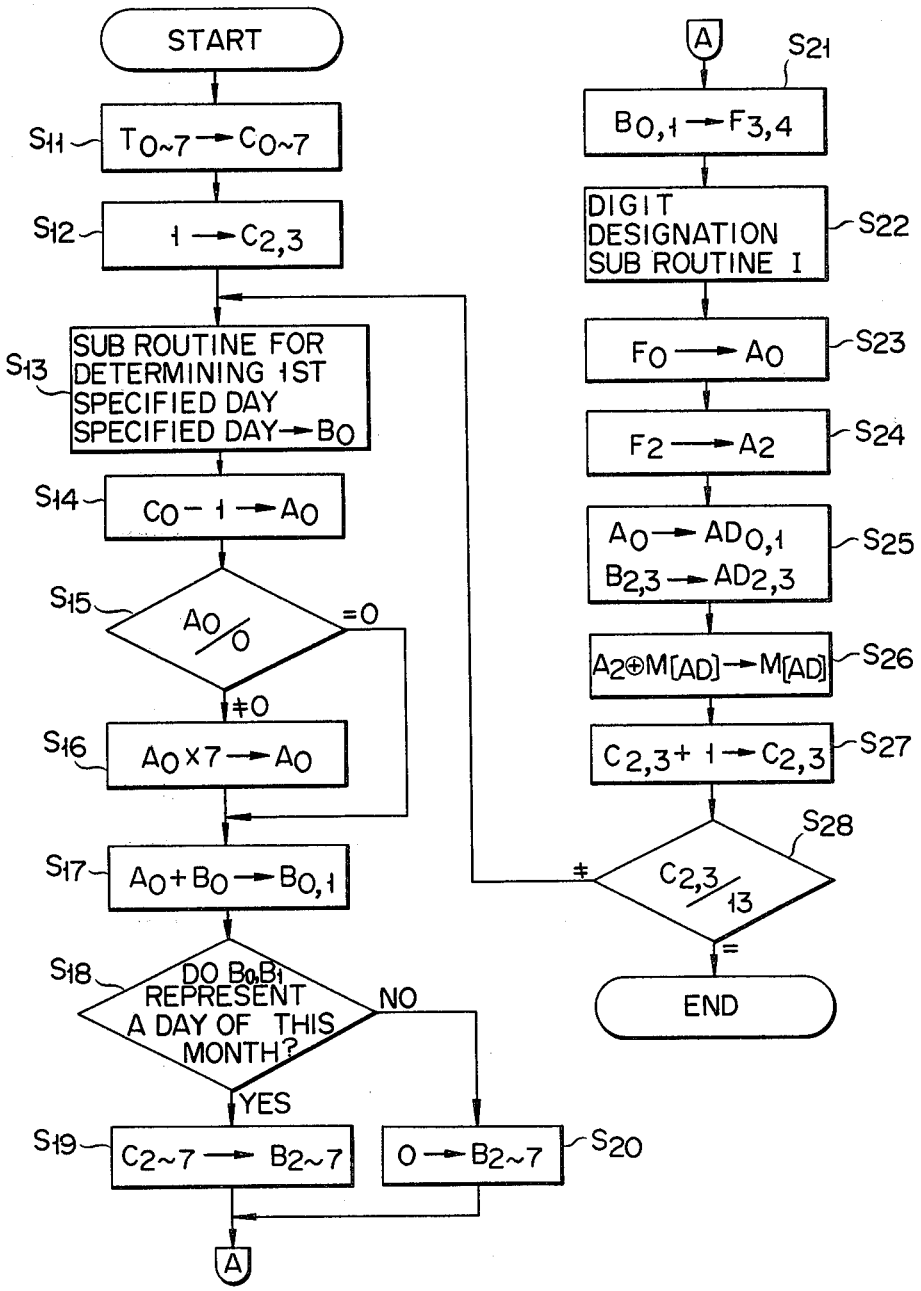
FIG. 4 is a flow chart for explaining the mode of operation of the device of the block circuit diagram of FIG. 1.

FIG. 3 shows the construction of the second RAM 16 shown in FIG. 1. As shown in FIG. 4, the second RAM 16 is capable of storing specified dates corresponding to one year. The second RAM 16 has 10-bit registers M1 to M12 corresponding to the respective months of January through December and is capable of storing information of four bits per digit. The data corresponding to the dates "1", "2", "3", . . . is stored for each bit from the lower significant digit of the registers (M1 to M12) of the respective months within the second RAM 16. When "1" is written in a certain bit, it indicates that the data corresponding to this bit is a specified date.

The mode of operation of the first embodiment of the present invention of this construction will be described. A case will be considered wherein the Friday of the second week of each month of 1980 is to be set. When the keys [1] [9] [8] [O] [DATE] [DATE] [5] [WEEK] [2] [SET] are operated in sequence for inputting the corresponding information, processing is performed according to the flow chart shown in FIG. 4. First, "19800052" is stored in T0 to T7 (digits 0 to 7) of the T register upon the key operations described above. Next, in step S11, "19800052" is transferred to C0 to C7 of the C register. Although not shown in the FIG. 4, the year data "1980" input by key operation is also transferred to steps S6 to S9.

The days of the weeks to be input are designated by "0" for Sunday, "1" for Monday, . . . "5" for Friday, and "6" for Saturday.

In step S12, an initial value "1" is set in C2 and C3 so that "January" as the initial value corresponds with the input data shown above. In step S13, a subroutine is called for obtaining dates of the specified days of the first week from January through December according to the keyed-in day, as will be described in more detail with reference to FIG. 5.

Figure 5:
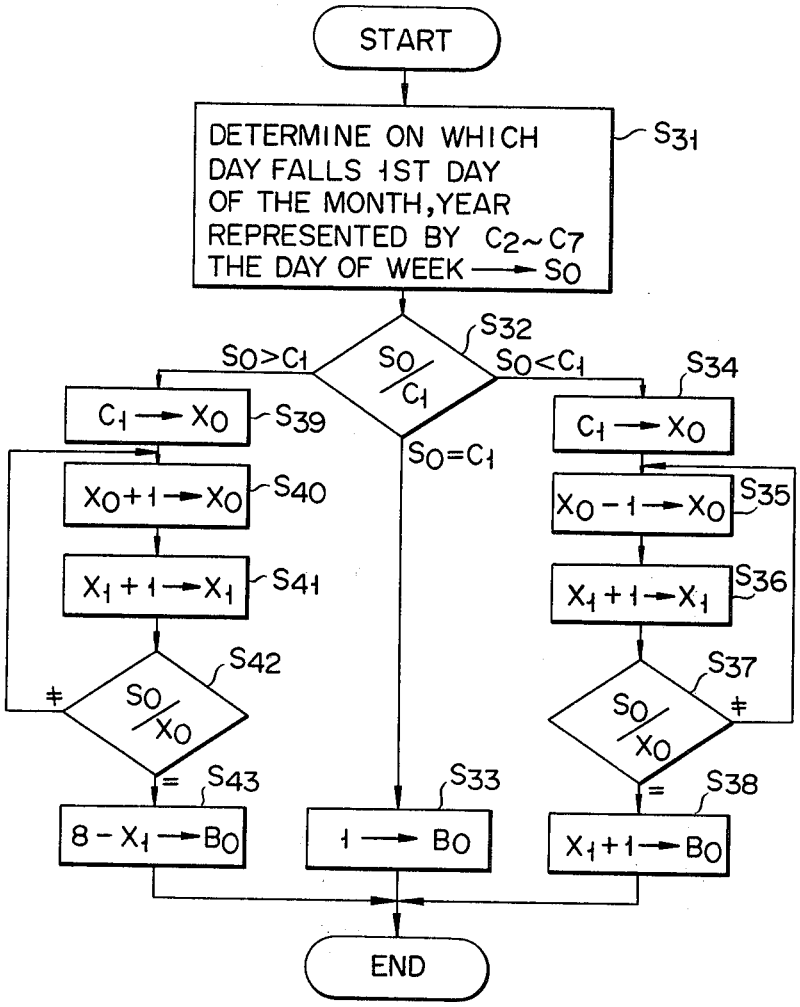
FIG. 5 is a flow chart showing the details of a subroutine for obtaining a first specified data of step S13 of the flow chart of FIG. 4.

In the subroutine shown in FIG. 5, the day corresponding to the first day of the month and year stored in C2 to C7 is obtained in step S31. The obtained day is stored in S0. Since Jan. 1, 1980 is a Tuesday, "2" is stored in S0. Next, in step S32, S0 storing the data on the first day obtained in Step S31 is compared with C1 storing the data on the day designated by the key operation. Since "2" is stored S0 and "5" is stored in C1, it is judged that "S0<C1". The program then advances to step S34 wherein the content of C1, "5", is transferred to X0. In step S35, the content of X0 is decremented by 1 to become "4" and, in step S36, the content of X1 is incremented by 1 to become "1". In step S37, the contents of S0 and X0 are compared to determine if they are equal. Since the content of S0 is "2" and the content of X0 is "4", the program returns to step S35. Steps S35, S36 and S37 are repeatedly executed until the contents of S0 and X0 are equal. When the content of X0 becomes "2" in step S37, the program advances to step S38 wherein the content "3" of X1 is incremented by 1 and "4" is stored in B0.

When it is judged that "S0=C1" in step S32, "1" is stored in B0 in step S33. When it is judged that "S0>C1" in step S32, the content of C1 is transferred to X0 in step S39. Then, in step S40, the content of X0 is incremented by 1. Next, the content of X1 is incremented by 1 in step S41. Then in step S42, the contents of S0 and X0 are compared. When the contents of S0 and X0 do not coincide in step S42, the processing of steps S40 and S41 is repeated until the contents of S0 and X0 coincide. When it is judged that the contents of S0 and X0 are equal in step S42, the program advances to step S43 wherein the content of X1 is subtracted from "8" and the subtraction result is stored in B0.

Figure 6:
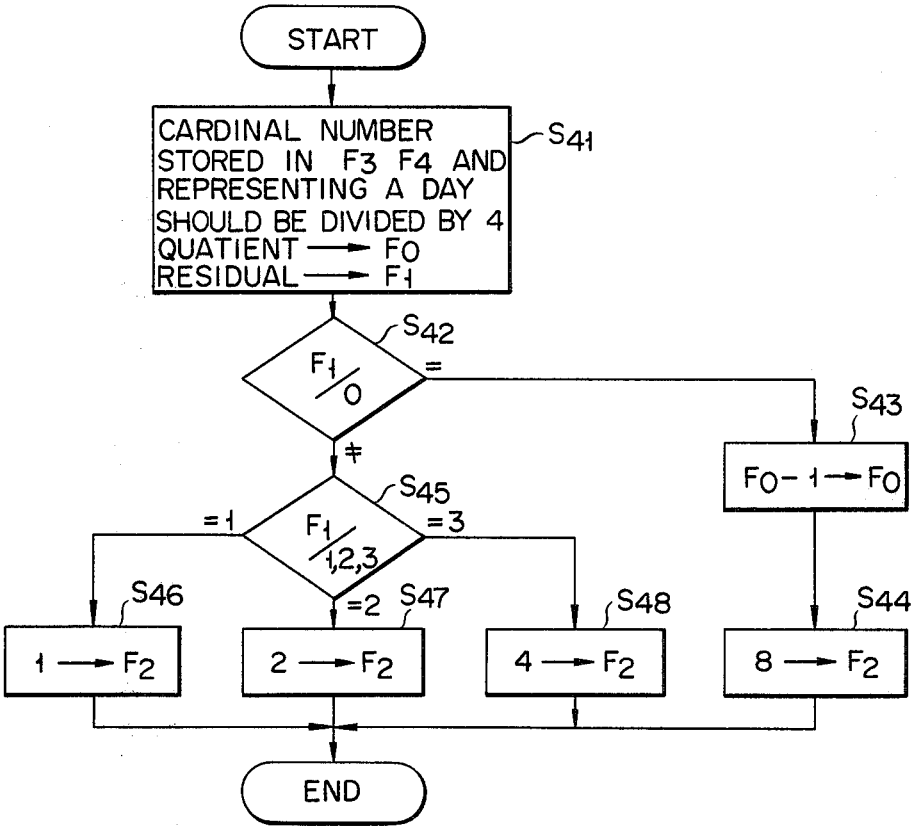
FIG. 6 is a flow chart showing the details of a digit designation subroutine I of step S22 of the flow chart of FIG. 4.

The operation for obtaining the date of the first Monday of "January" designated in C1 and C3 is performed in this manner. The date obtained by this operation is stored in B0. Since the date of the first Monday of January of 1980 is "4", "4" is stored in B0 and the program advances to step S14 of FIG. 4. In step S14, 1 is subtracted from the data "2" representing the week of the month which is stored in C0, and the result "1" is stored in A0. The content of A0 is the data for renewing the data obtained in step S13 according to the week data. In step S15, a judgment is made as to whether or not the content of A0 is "0". When it is judged that the content of A0 is not "0" in step S15, A0×7 is executed in step S16 ad its result is stored in A0. Since the content of A0 is "1", the program advances to step S16, and the content of A0 becomes "7". Then, in step S17, A0+B0 is executed; the date "4" of the first Friday of January is added to the content "7" of A0. The date "11" of the second Friday of January is stored in B0 and B1. When it is judged that the content of A0 is "0" in step S15, the date is not renewed since the first week has been designated, and the program advances to step S17. In step S18, a judgment is made as to whether or not the date stored in B0 and B1 is a date of the month in question (January). Since "11" is stored in B0 and B1, a judgment of "YES" is made is step S18. The program thus advances to step S19 wherein the month and year information "198001" stored in C2 to C7 is transferred to B2 to B7. When a judgment of "NO" is made in step S18, "0" is stored as an error in B2 to B7. Next, in step S21, the date "11" stored in B0 and B1 is transferred to F3 and F4. A digit designation subroutine of the second RAM 16, which is to be described with reference to FIG. 6, is called in step S22. Then an operation for obtaining the digit address in a predetermined column address of the second RAM 16 and the numerical data to be stored at this digit address is performed according to data "11" stored in F3 and F4.

When the digit designation subroutine shown in FIG. 6 is called, the data "11" stored in F3 and F4 is divided by 4 in step S41; the quotient "2" is stored in F0 and the remainder "3" is stored in F1. Next, in step S42, a judgment is made as to whether or not the content of F1 is "0", that is, whether or not there is a remainder. Since the content of F1 is "3" in this case, judgment is made that F1≠0, and step S45 is then executed. In step S45, it is judged whether the content of F1 is "1", "2", or "3". When a judgment is made that F1=1 in step S45; a binary number "0001" (decimal number 1) weighted 8, 4, 2 and 1 for each digit is stored in step S48. When a judgment is made that F1=2 in step S45; a binary number "0010" (decimal number 2) is stored in step S47. Finally, when it is judged that F1=3 in step S45, a binary number "0100" (decimal number 4) is stored in step S48. Since the content of F1 is "3" in this case, the program advances to step S48 wherein a decimal number "4" (binary number "0100") is stored in F2.

When F1=0 in step S42, "F0−1" is stored in step S43. When there is no remainder in the operation of step S41, the digit address to be designated is shifted by one digit since the date is a multiple of "4". The content of F0 is decremented by "1" for correcting this. In step S44, a binary number "1000" (decimal number 8) is stored in F2.

In summary, in the digit designation subroutine, the data to be written in the corresponding digits of the registers (M1 to M12) of the second RAM 16 corresponding to the keyed-in data for year, week, and day is stored in F2.

Figure 7:
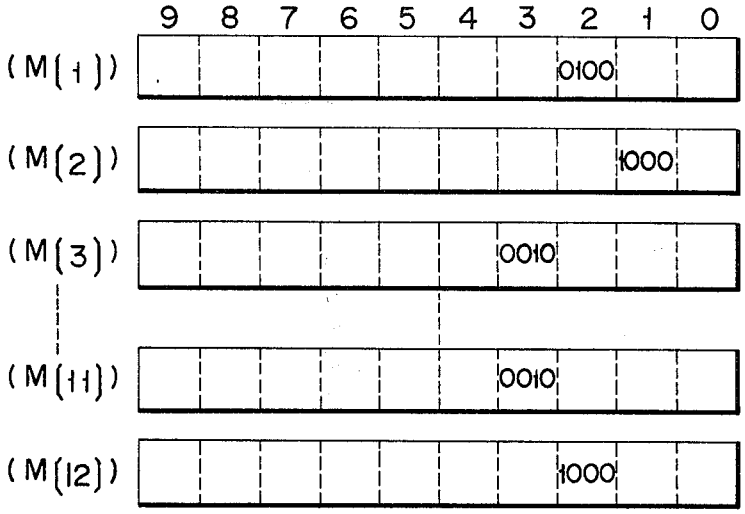
FIG. 7 shows the stored state of the second RAM 16 shown in FIG. 1 when it has operated according to the flow chart of FIG. 4.

When the execution of the digit designation subroutine shown in FIG. 6 is terminated, the program advances to step S23 shown in FIG. 4. In this step S23, the data "2" stored in F0 as the output of the digit designation subroutine is stored in A0 as the digit address. In step S24, the content "4" (binary number "0100") of F2, which is to be stored in the digit designated as a result of the digit designation routine described above, is stored in A2. Next, in step S25, the digit address "2" stored in A0 is stored in AD0 and AD1 of the digit 0 and 1 of the address register AD in the address control section 13, and the month information "1" stored in B2 and B3 is stored in AD2 and AD3. Next, in step S26, the register M1 of the second RAM 16 is designated by the month data "1" stored in AD2 and AD3, a digit of the second RAM 16 is designated by the digit address "2" stored in the AD0 and AD1, and the data stored in the designated area is read out once and is thereafter supplied to the operation circuit 18 through the latch circuit 17. The numerical data "4" (binary number "0100") stored in A2 is also supplied to the operation circuit 18 through the latch circuit 17 and is OR-added to the above-mentioned data. By "OR-addition" is meant a binary operation between bits; for example, "1"+"1"="1", "0"+"1"="1", and "0"+"0"="0" in the addition of data of four bits. The result of OR-addition is stored again in the area designated by AD0, AD1, AD2 and AD3. The flag is stored in the 11th bit of the register M1 corresponding to the date of the Friday of the second week, in the second RAM 16 as shown in FIG. 7. The Friday of the second week of January is set in the second RAM 16 in this manner. Next, in step S27, the content "1" of C2 and C3 is incremented by 1 to renew the month, and the program advances to the processing for obtaining the date of the Friday of the second week of February. In step S28, a judgment is made as to whether or not the content of C2 and C3 is "13", that is, whether or not the month data stored in C2 and C3 exceeds "12". When it is judged that the content of C2 and C3 is not "13" in step S28, the program returns to step S13 wherein the processing for obtaining the date of the Friday of the first week of February is performed, and the processing for obtaining the date of the Friday of the second week of February is performed based on this result. The second Fridays of the months March through December are calculated in the same manner as described above until a judgment is made that the contents of C2 and C3 are "13" in step S28. Then, as shown in FIG. 7, the second Fridays of the months during 1980 are set in the registers M1 to M12 of the second RAM 16.

Figure 9:
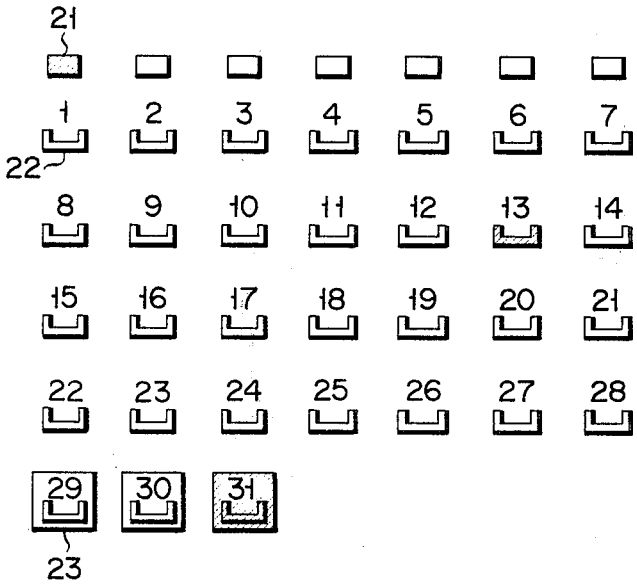
FIG. 9 is a view showing the state of the second RAM 16 when the data stored as shown in FIG. 7 is displayed.
Figure 8:
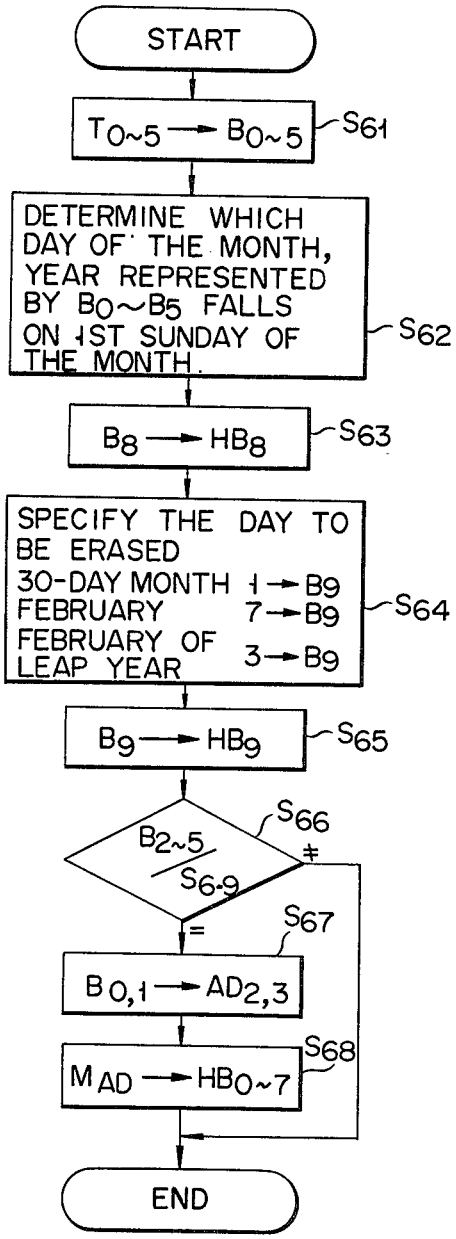
FIG. 8 is a flow chart for explaining the mode of operation for displaying the data stored in the second RAM 16 shown in FIG. 7.

The mode of operation for displaying the calendar stored in the second RAM 16 will now be described with reference to the flow chart of FIG. 8. For displaying the calendar of June of 1980, for example, when keys [1] [9] [8] [0] [DATE] [6] [DATE] [CALE] are operated in sequence, the processing of the flow chart shown in FIG. 8 is executed. Upon this sequence of key operations, "198006" is stored in T0 to T5. Thereafter, the entered data "198006" stored in T0 to T5 is transferred to B0 to B5 in step S61. Next, in step S62, the date of the first Sunday is calculated from the year and month data stored in B0 to B5. Since the first Sunday of June of 1980 is the 1st, "1" is stored in B8. In step S63, the date "1" of the first Sunday stored in B8 is transferred to the display buffer HB8. In step S64, unnecessary days, according to whether the month is a 31-day or 30-day month, are eliminated for displaying the calendar at the display section 19. When the current month is a 30-day month as determined by the year and month data stored in B0 to B5, "1" is stored in B9. When the current month is February of a non-leap year, "7" is stored in B9. When the current month is February of a leap year, "3" is stored in B9. Since the input month data in this case of June, "1" is stored in B9. Next, in step S65, the content of B9 is transferred to the display buffer HB9. In step S66, the year "1980" stored in S6 to S9 for the calendar set in the second RAM 16 is compared with the year stored in B2 to B5 and displayed at the display section. Since they are judged to be equal in step S66, the month data "02" stored in B0 and B1 is then stored in AD2 and AD3 in step S67. Next, in step S68, the content of the register M6 for the specified days of June in the second RAM 16 is transferred to the display buffers HB0 to HB7. When the years are judged not to equal each other in step S66, the display is not performed. When the execution of step S68 is completed, the calendar of June, 1980 is displayed as shown in FIG. 9 according to the contents of the display buffers HB0 to HB7. Referring to FIG. 9, the dates of 1 to 31 are arranged in a matrix form, and a Sunday display segment 21 is assigned for each row. Display segments 22 for displaying specified dates are arranged below the respective dates. The 29th, 30th and/or 31st days are masked with masks 23 when appropriate, to prevent their being displayed. Then, according to the content of the display buffer HB8, the Sunday display segment 21 is displayed, and the display segment 22 for displaying the specified date for the 13th of June (the second Friday of June) preset in the second RAM 16 is also displayed.

In the above embodiment, setting of the specified dates is performed by inputting the relevant year, week and day. However, in another embodiment to be described below, all the predetermined days of a particular month may be set by inputting the relevant year, month, and day data.

Thus, another embodiment of the present invention will now be described with reference to FIG. 10.

Figure 10:
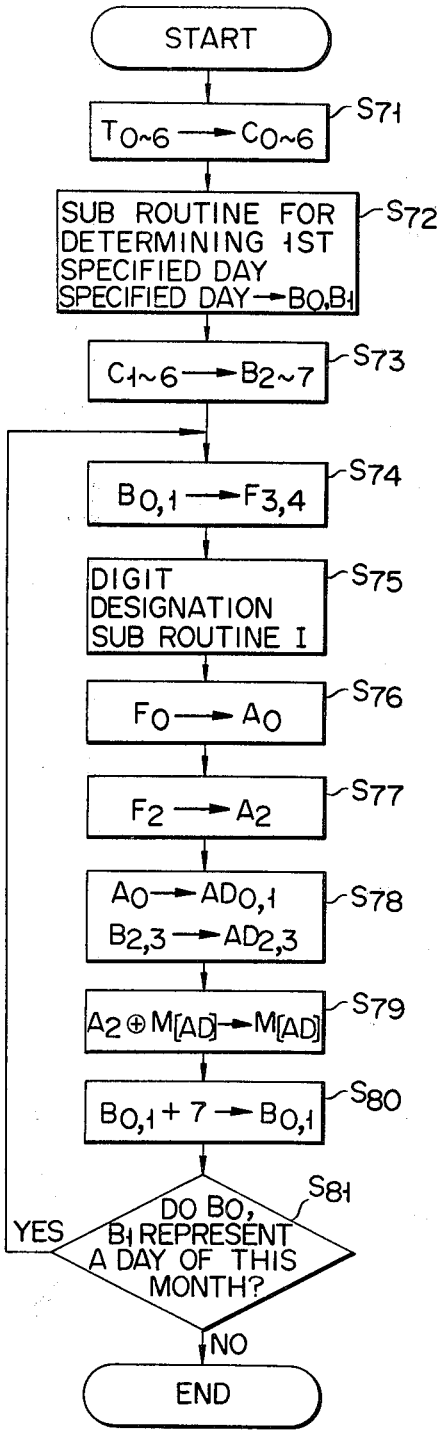
FIG. 10 is a flow chart for explaining the mode of operation of another embodiment of the present invention.

When the keys [1] [9] [8] [0] [DATE] [4] [DATE] [2] [WEEK] [SET] are operated in sequence of the key input section for setting every Tuesday of April of 1980, the processing of the flow chart shown in FIG. 10 is executed. First, in step S71, the entered data "1980042" input by key operation and stored in T0 to T6 is transferred to C0 to C6. Next, in step S72, a subroutine for obtaining a first specified date as described in detail with reference to FIG. 5 is called. Then, as an output of this subroutine, the date "1" of the first Tuesday of April is stored in B0 and B1. Next, in step S73, the data "198004" stored in C1 to C6 is transferred to B2 to B7. In step S74, the date "1" of the first Tuesday of April stored in B0 and B1 is then stored in F3 to F4. Next, in step S75, a digit designation subroutine as shown in FIG. 6 is called. Then, the digit designation data in F0 is transferred to A0 in step S76. Further, in step S77, the data "1" in F2 is transferred to A2. The "1" stored in A0 indicating the digit address is transferred to AD0 and AD1 in step S78, and the month data "4" stored in B2 and B3 is subsequently stored in AD2 and AD3. In step S79, as in the case of step S26 of FIG. 4, OR-addition of the content of A2 and the predetermined digit of the register M4 for the specified day of April addressed by AD is performed. Next, in step S80, the date "1" of the first Tuesday of April stored in B0 and B1 is added to "7", and the date "8" of the second Friday of April is newly stored. Next, in step S81, a judgment is made as to whether or not the date "8" stored in B0 and B1 represents a day of the current month. When a judgment of "YES" is made in step S81, the processing following step S74 is executed so that the flag is stored in the bit corresponding to the date "8" of the second Friday in the register M4 for specified days of April. The processing as described above is repeated until a judgment of "NO" is made in step S81, and every Tuesday of April is set in the register M4 for specified days of April in the second RAM 16.

In the above embodiment, the predetermined days of a particular month are set by inputting the year, month and day. However, it is also possible to set a specific week of a predetermined month among all the weeks by inputting the year, month and week.

Another embodiment of the present invention will thus be described with reference to FIGS. 6, 8, 11, 12(A), 12(B), 12(C) and 13.

Figure 11:
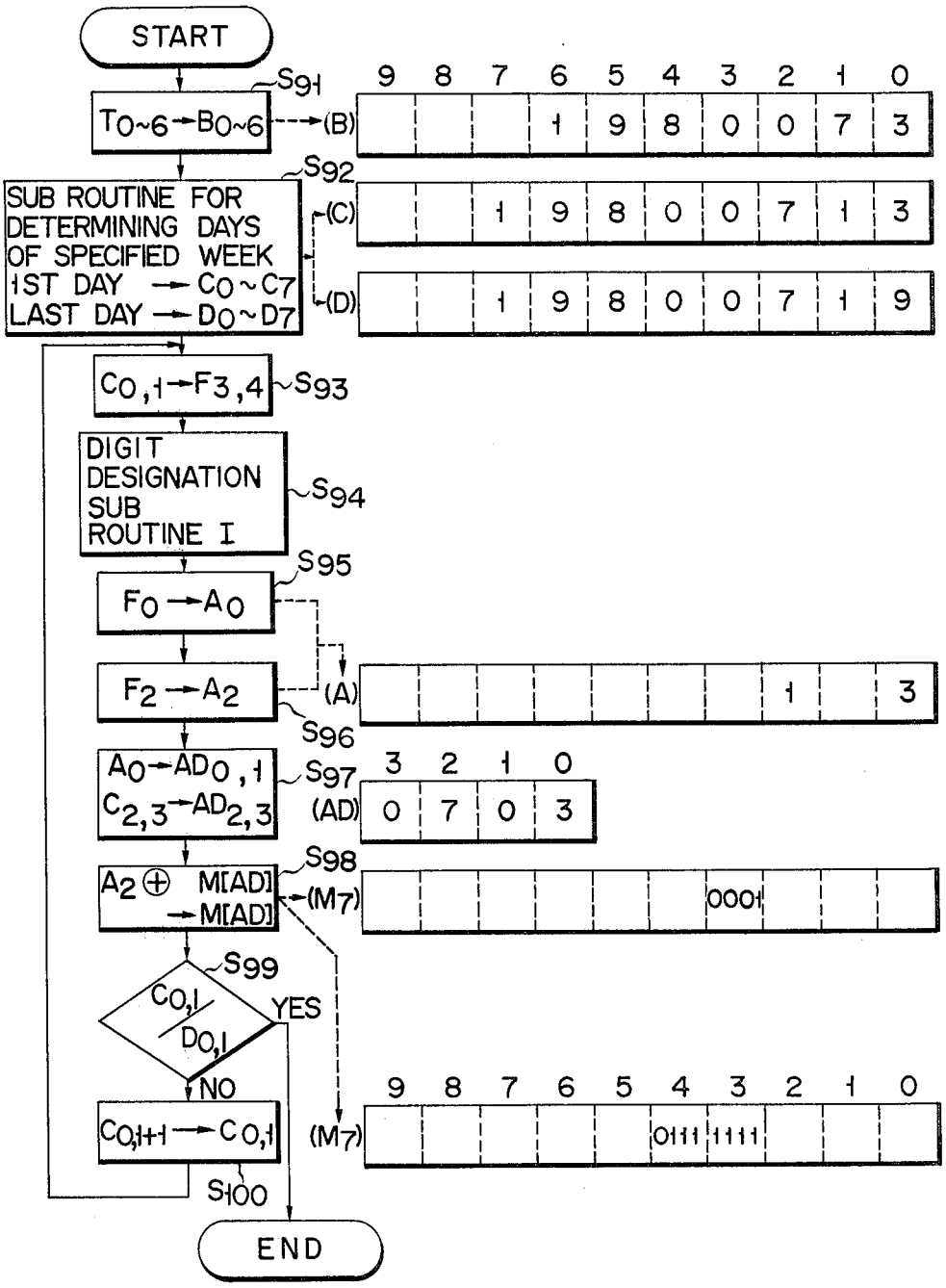
FIG. 11 is a flow chart for explaining the mode of operation of still another embodiment of the present invention.

A case will be considered for setting the dates of the third week of July of 1980. The keys [1] [9] [8] [0] [DATE] [7] [DATE] [3] [WEEK] [SET] are operated in sequence at the key input section 11. Then, the processing shown by the flow chart of FIG. 11 is initiated. The entered data "1980073" input from the key input section 11 is stored in the T register of the first RAM 15. Next, the contents of the 0 to 6th digits of the T register are transferred to the 0 to 6th digits of the B register in step S91. In step S92, the date of the first day (initial date for calculation) of the third week of July of 1980, obtained by the date-calculating subroutine of a particular week to be described later with reference to FIG. 12, is stored in the 0 to 7th digits of the C register, and the last day (calculated day) of the third week of July of 1980 is stored in the 0 to 7th digits of the D register. In the case of this embodiment, July 13 of 1980 is stored in C0 to C7, to July 19 of 1980 is stored in D0 to D7. Next, in step S93, the initial date "13" stored in the 0th and 1st digits of the C register is transferred to the 3rd and 4th digits of the F register. In step S94, the digit designation subroutine described with reference to FIG. 6 above is executed, the data "13" stored in F3 and F4, that is, the digit of the predetermined column address of the second RAM 16 corresponding to "13", and the data stored in this digit are calculated. Since "3rd digit" and "1" are obtained in the case of the "13th day", the flag "1" is stored at the 13th bit in step S94. In step S95, the digit-designating data "3" of the register of the second RAM 16, stored in the 0th digit of the F register as the output data of the digit designation subroutine, is stored in the 0th digit of the A register. In step S96, the data "1", written in the respective digits of the register which are stored in the second digit of the F register, is stored in the second digit of the A register. Next, in step S97, the data "3" stored in the 0th digit of the A register is stored in the 0th and 1st digits of the address register AD of the address control section 13. Then, the month data "7" stored in the 2nd and 3rd digits of the C register is stored in the 2nd and 3rd digits of the address register AD.

As a result, the 3rd digit of the register M7 of the second RAM 16 is address-designated according to the content of the address register AD. Then, the content of A2 is OR-added with the content of the 3rd digit of the register M7 of the second RAM 16 address-designated by the address register AD, and the result is stored in the 3rd digit of the memory M7. In step S99, the date "13" stored in C0 and C1 is compared with the last date 37 19" of the set period stored in D0 and D1, and the processing is terminated when they coincide with each other. On the other hand, when they do not coincide, the contents of C0 and C1 are incremented by 1 in step S100 and the program returns to S93. Since the contents of C0 and C1 do not coincide with the contents of D0 and D1 in this case, the processing of S93 to S98 is repeated until a judgment of "YES" is made in step S99. Thus, the date in C0 and C1 is sequentially renewed and flags are included in the predetermined bits of the register M7 corresponding to these dates. Therefore, flags are included in the 13th or 19th bits of the register M7 for the specified days of July in the second RAM 16.

Figure 12A:
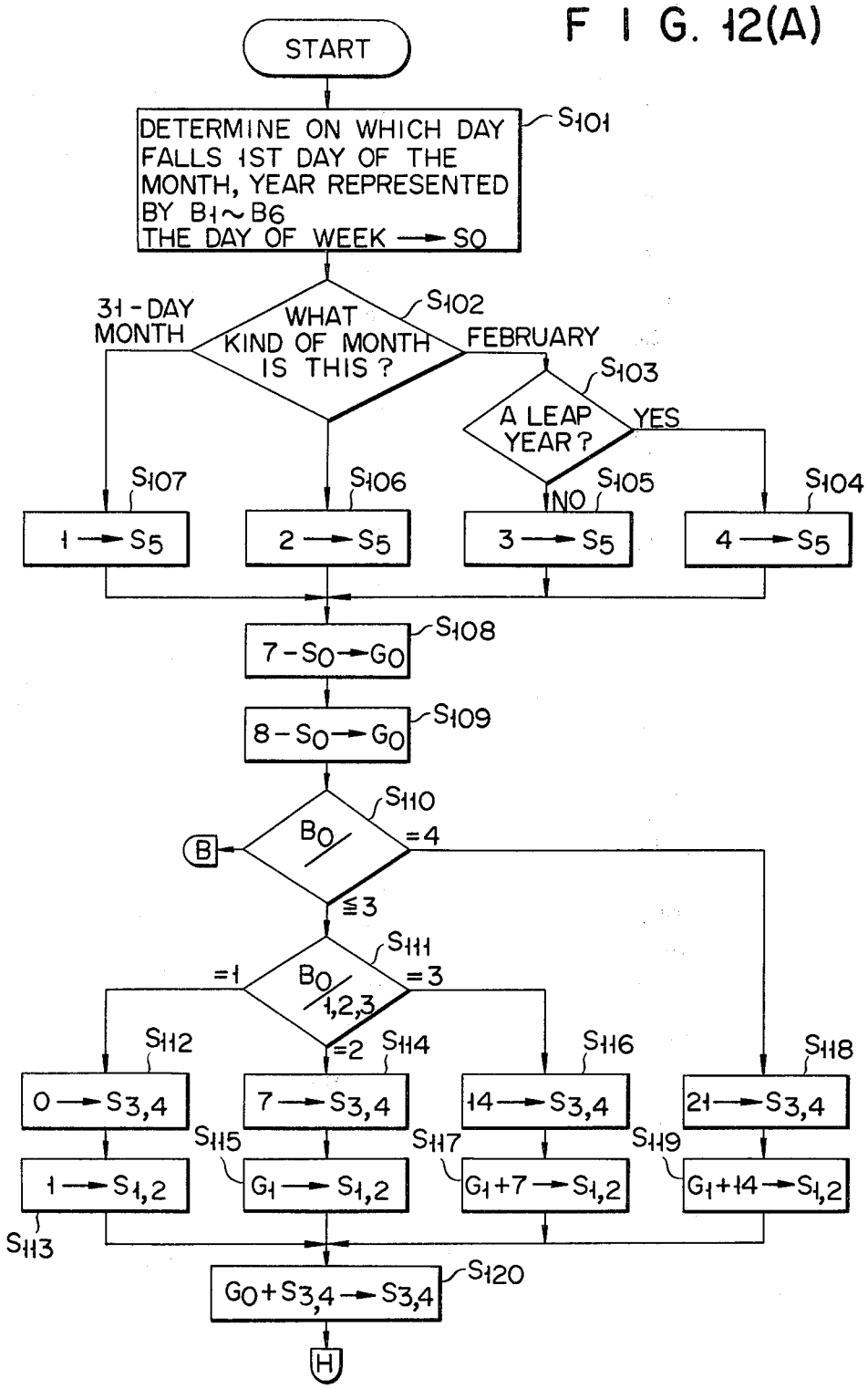
FIGS. 12(A) to 12(C) are flow charts for showing the details of a subroutine for calculating the dates of a particular week in step S92 of the flow chart of FIG. 11.
Figure 12B:
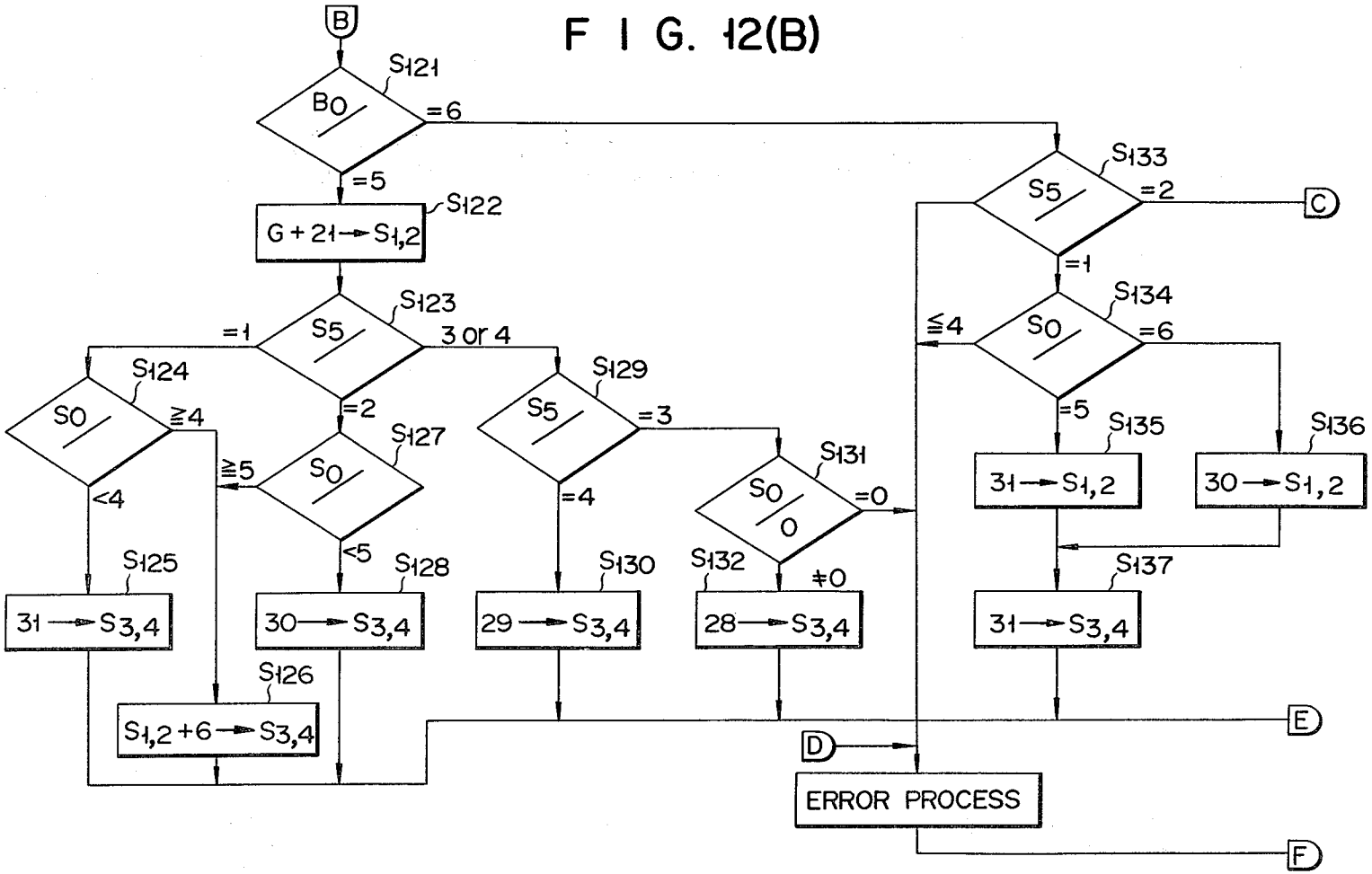
Figure 12C:
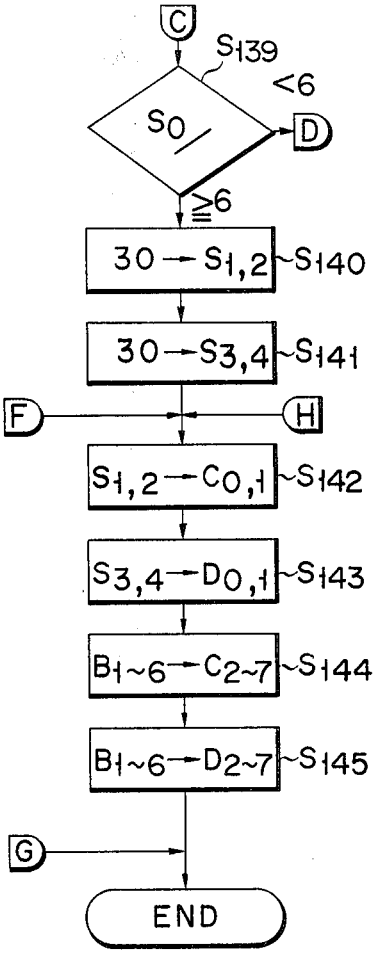

Next, flow charts of subroutine for calculating the dates of the specified week are shown in FIGS. 12(A), 12(B) and 12(C). First, in step S101, the day of the 1st day of the month in question is calculated by a suitable method from the year and month data "198007" stored in the 1st to 6th digits of the B register. Numerical data "0" to "6" is stored in the 0th digit S0 of the S register in correspondence with "Sunday" to "Saturday". Since July 1 of 1980 is a Tuesday, "2" is stored in S0. Next, in step S102, the kind of month is judged according to the contents of B1 and B2. When the month is judged to be "February" in step S102, step S103 is executed wherein a judgment is made as to whether or not the year in question is a leap year according to the contents of B3 to B6 (the year data). When a judgment of "YES" is made in step S103, "4" is stored in the 5th digit S5 of the S register in step S104. On the other hand, when a judgment of "NO" is made in step S103, "3" is stored in S5. When it is judged that the month in question is a 30-day month (last day of the month is the 30th) in step S102, "2" is stored in S5 in step S106. When it is judged that the month in question is a 31-day month (last day of the month is the 31st) in step S102, "1" is stored in step S107. Since July in this case is a 31-day month, the program advances to S107 and "1" is written in S5. Then, in step S108, "7–S0", that is, "7–2" is calculated and the result "5" is stored in the 0th digit G0 of the G register. Further, in step S109, "8–S0", that is, "8–2" is calculated and the result "6" is stored in G1. Next, in step S110, the specified week is determined from the content of the 0th digit B0 of the B register. When the content of B0 is judged to be 3 or less in step S110, a judgment is made as to whether the content of B0 is 1, 2 or 3 in step S111. When it is judged that B0=1 in step S111, "0" is stored in S3 and S4 in step S112 and "1" is stored in S1 and S2 in step S113. When it is judged that B0=2 in step S111, "7" is stored in S3 and S4 in step S114, and the content of G1 is stored in S1 and S2 in step S115. When it is judged that B0=3 in step S111, "14" is stored in S3 and S4 in step S116. The result of "G1+7" is stored in S1 and S2 in step S117. When it is judged that B0=4 in step S110, "21" is stored in step S118, and the result of "G1+14" is stored in S1 and S2 in step S119. Finally, the result of "G0+S3,4" is stored in S3 and S4 in step S120. Since "3" is stored in B0 in this case, the program advances to step S116, and "14" is stored in S3 and S4. The program then advances to Step S117, wherein "7" is added to the content "6" of G1 and "13" is written in S1 and S2. In step S120, the content "5" of G0 is added to the content "14" of S3 and S4, and the result "19" is stored in S3 and S4. Therefore, the initial data and the final data of a particular week of the 1st to 4th weeks are stored, according to the content of B0, in the 1st and 2nd digits S1 and S2 and the 3rd and 4th digits S3 and S4 of the S register, respectively. These dates are limited only to dates encompassed by the year, month and day information.

When it is judged that B0=5 or B0=6 in step S110, step S121 shown in FIG. 12(B) is executed. When it is judged that B0=5 in step S121, the program advances to step S122 wherein the result of "G1+21" is stored in S1 and S2. Next, the content of S5 is judged in step S123. When S5=1, step S124 is executed. When S0 is less than "4", step S125 is executed and "31" is stored in S3 and S4. On the other hand, if the content of S0 is judged to be greater than or equal to "4" in step S124, step S126 is executed and the result of "S1,2+6" is stored in S3 and S4 in step S126. When it is judged that S5=2 in step S123, the program advances to step S127. In step S127, the content of S0 is judged. When the content of S0 is judged to be "5" or more, the program returns to step S126. On the other hand, when the content of S0 is judged to be less than 5 in step S127, "30" is stored in S3 and S4 in step S128. When the content of S5 is judged to be "3" or "4" in step S123, the program advances to step S129 wherein a judgement is made as to whether the content of S5 is "3" or "4". When it is judged that S5=4, "29" is stored in S3 and S4 in step S30. On the other hand, when it is judged that S5=3 in step S129, the program advances to step S131. Then, in step S131, a judgment is made as to whether or not the first day of the month S0 is a "Sunday" in step S131. When the first day of the month S0 is not a "Sunday" in step S131 (S0≠0), "28" is stored in S3 and S4 in step S132. By the processing from step S122 to step S132 as described above, the initial data of the fifth week of the designated month is stored in S1 and S2 and the last date of the fifth week is stored in S3 and S4.

On the other hand, when in step S121 it is judged that the sixth week is designated (B0=6), the program advances to step S133. In step S133, the content of S5 is judged. When it is judged that S5=1, step S134 is executed wherein the content of S0 is judged. When the content of S0 representing the day of the first day of the month is "5" (Friday), step S135 is executed and "31" is stored in S1 and S2. On the other hand, when the content representing the day of the 1st is judged to be "6" (Saturday) in step S134, step S136 is executed wherein "30" is stored in S1 and S2. Then, in step S137, "31" is stored in S3 and S4. When the content of S0 representing the day of the 1st is judged to be less than or equal to "4" (Thursday) in step S134, the month in question does not have a sixth week, so step S138 is executed. In step S138, error processing is performed, during which time the system is placed under the error condition and operations such as display of errors are performed. When a judgment is made that S5=2 in step S133, step S139 shown in FIG. 12(C) is executed. In step S139, the content of S0 is judged. When a judgment is made that the content of S0 representing the day corresponding to the 1st of the month is less than "6" (Saturday), the program advances to step S138 and error processing is performed. On the other hand, when it is judged that the content of S0 representing the day corresponding to the 1st of the month is greater than or equal to "6" (Saturday) in step S139, steps S140 and S141 are executed and "30" is stored in S1 and S2, and in S3 and S4. Further, when it is judged that the content of S5 is "3" or "4" in step S133, the error processing is performed in step S138. Then, in step S142, the initial date of the designated week of the designated month stored in S1 and S2 is stored in C0 and C1. In the next step S143, the last date of the designated week stored in S3 and S4 is stored in D0 and D1. Next, in steps S144 and S145, the year and month data stored in B1 to B6 is stored in C2 to C7 and in D2 to D7. Thus, "13" is stored in S1 and S2 and "19" is stored in S3 and S4 in steps S117 and S120; the program advances from step S120 to step S142 and "13" is stored in C0 and C1; and "19" is stored in D0 and D1 in step S143. In steps S144 and 145, the year and month data "198007" are written in C2 to C7 and in D2 to D7, and the program then returns to step S93 described above with reference to FIG. 11.

According to the series of processing procedures described above, the dates 13 to 19 of the third week of July of 1980 input by the key operations are sequentially obtained and are stored by including flags "1" in the 13th to 19th bits of the register M7.

The display of the period designated in the manner described above may be performed according to the operation shown in FIG. 8.

Figure 13:
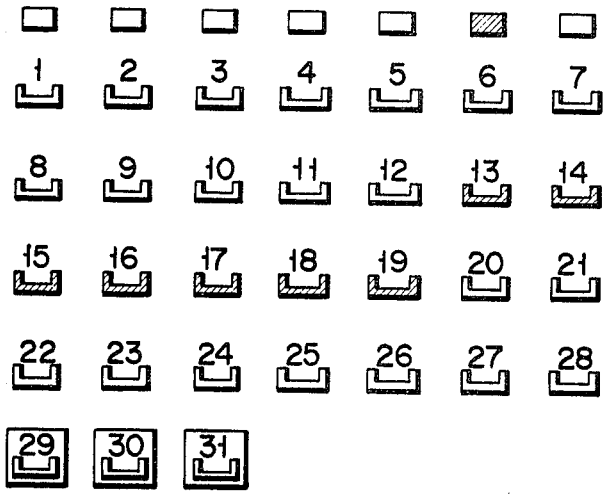
FIG. 13 shows the displayed state according to the flow chart of FIG. 11.

For example, for displaying the calendar of July of 1980, the keys [1] [9] [8] [DATE] [7] [DATE] [CALE] are sequentially operated, whereupon operation according to the flow chart shown in FIG. 8 is executed and the display is performed as shown in FIG. 13.

Although the initial and final dates of the specified week were calculated in the above embodiment, the present invention is not limited to this particular embodiment. For example, the initial date and the number of days from the initial date may be calculated instead.

In the above embodiment, flags were included in the bits of the register corresponding to the dates of the specified period. However, the dates of the specified period may be sequentially stored, or the initial date and the final date only may be stored. Furthermore, in the above embodiment, the dates of the specified period were displayed at the display section together with the calendar. However, when a printer is available, the dates may be printed together with the calendar. Further, the method and form of display of the calendar may be accomplished in any other suitable manner. In addition, it is to be understood that these embodiments and modifications are also applicable to portable calculators having a timepiece function.

In the above embodiment, the year, month and week data is input for specifying all the predetermined weeks of desired months. However, it is also possible to specify the entire desired period from a predetermined year, month and day, by inputting year, month, date and period data.

Figure 15:
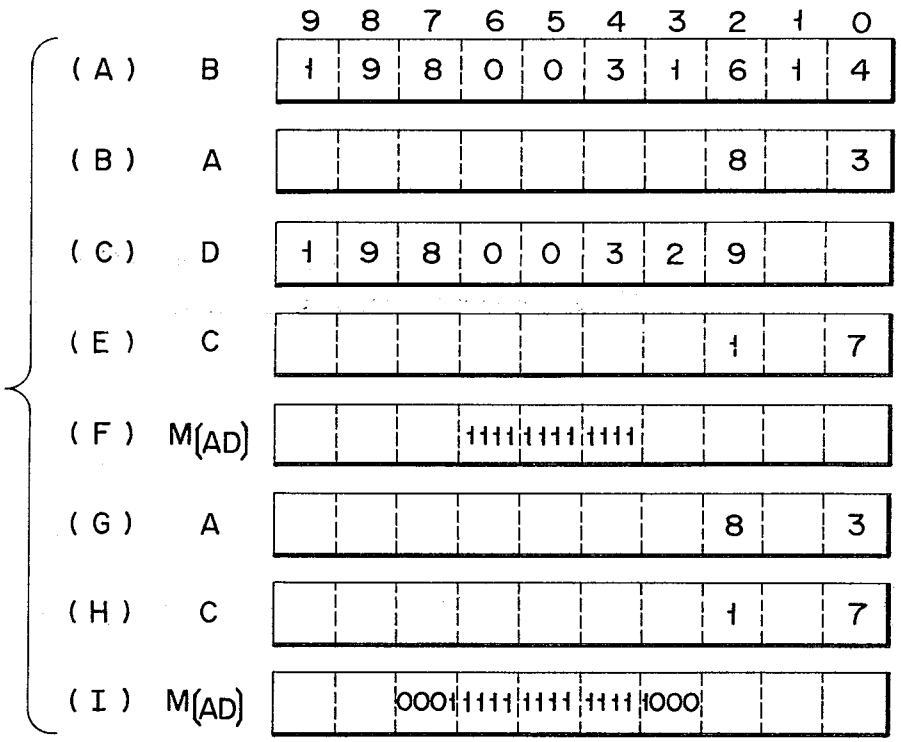
FIG. 15 shows the stored state of the second RAM 16 of FIG. 1 when it has operated according to the flow charts of FIGS. 14(A) and 14(B)

Still another embodiment of the present invention will now be described with reference to FIGS. 14(A), 14(B), 15, 16 and 17. A description will be made for the case of specifying 14 days from March 16 of 1980 as specified days. When the keys [1] [9] [8] [DATE] [3] [DATE] [1] [6] [DATE] + [1] 4 [SET] are operated in sequence at the key input section 11, the operation is performed according to the flow charts shown in FIGS. 14(A) and 14(B). In step S151, the entered data "1980031614" stored in the T register is transferred to the B register (see FIG. 15(A); the state of the registers is shown in FIG. 15). Next, in step S152, the content "16" of the digits B3 and B2, the 3rd and 2nd digits of the B register, is transferred to digits F3 and F4. Then, the digit designation subroutine I, described above with reference to FIG. 6, is executed.

This digit designation subroutine I is for setting the specified dates in the second RAM 16. The digit designation of the second RAM 16 and the data to be set are calculated according to the date "16" of the digits F3 and F4. The digit designation data "3" is stored in F0, and the numeral "8" (binary number "1000") is stored in FIG. 2.

Subsequently, the content "3" of F0 which is output as the result of the digit designation subroutine I is stored in A0 in step S154. Then, in step S155, the content "8" of F2, which is output as the result of the digit designation subroutine I, is stored in A2 (FIG. 15(B)). In step S156 to follow, a reference number of days is calculated from the content "19800316" of B2 to B6.

This reference number of days is the number of days from a reference day (e.g., March 1 of 1980) to the date in question. This reference number of days is given, for example, by one of the following expressions.

When the year, month and day information to be input is year A, month B, and day C, the calculation of the number of days may be executed according to expression (1) if $B \geqq 3$:

$$A \times 365.25 + (B-3) \times 30.6 + C \quad \ldots (1)$$

The calculation may be executed according to expression (2) below if $B < 3$:

$$(A-1) \times 365.25 + (B+9) \times 30.6 + C \quad \ldots (2)$$

When performing the calculation, the decimal place values in the calculation of the year are rounded off and the decimal place values in the calculation of the month are rounded. For the example of March 16 of 1980, the calculation may be performed utilizing expression (1) substituting $A=80$, $B=3$, and $C=16$. Then, the number of days from March 1 of 1900 to March 16 of 1980 is calculated to be 29,248. Then, in step S157, to the reference number of days "29248" obtained in step S156 is added the content "14" of B0 and B1. Since the initial date March 16 is included in this result, "1" is subtracted from the obtained result for correction, providing the reference number of days "29261".

The data corresponding to this reference number of days is calculated and the obtained date is stored in D2 to D9. Thus, "19800329" is written in D2 to D9, as shown in FIG. 15(C).

Next, in step S158, the content "29" of D2 and D3 is transferred to F3 and F4. In step S159, the digit designation subroutine I is called and executed whereby "7" is stored in F0 and "1" is stored in F2. Next, in step S160, the content "7" of F0 for storing the result of the digit designation subroutine I is stored in C0. In the next step S161, the content "1" of F2 for storing the result of the digit designation subroutine I is stored in C2 (FIG. 15). In step S162, the month data "3" of the month including the initial date stored in B4 and B5 is compared with the month data "3" after the elapse of the period stored in D4 and D5. Judgment is made as to whether or not the month changes by inputting the predetermined period from the initial date in step S162. If the comparison indicates that the month data are equal to each other in step S162, step S163 is executed; if not equal, step S164 is executed. In step S163, the operation of "C0–A0" is executed.

If the operation result of step S163 is "0", the program jumps to step S178; if the result is "1", the program jumps to step S173; and if the result is greater than "1", the program jumps to S164. In step S163, the digit storing the flag of the initial date in the register for the specified day of March is compared with the digit storing the flag of the day after the elapse of the predetermined period of 14 days. In this case, since $C0=7$ and $A0=3$, the result of "C0–A0" is "4" and the program advances to S164. In step S164, the content "3" of A0 for designating the digit of the second RAM 16 is incremented by "1", and the result "4" is stored in E0. Next, in step S165, the content "4" of E0 is stored in digits AD0 and AD1 of the address register AD of the address control section 13, and the content "3" of B4 and B5 is transferred to AD2 and AD3.

Figure 16:
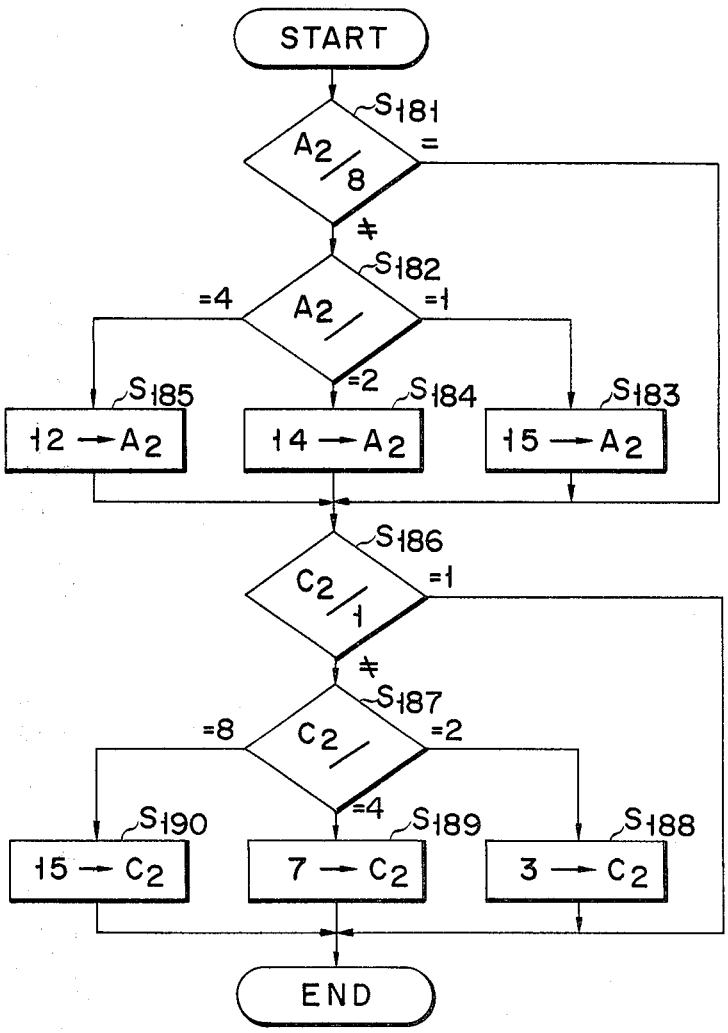
FIG. 16 is a flow chart showing the details of a digit designation subroutine II shown in steps S173 and S178 of FIG. 14(B)

The column designation is performed according to the content of AD0 and AD1 of the address register AD. In step S166, "1111" (decimal number "15") is stored in the 4th digit of the register M3 for the specified day of March in the second RAM 16 address-designated by the content "0304" of the address register AD. Next, in step S167, the content "4" of E0 is incremented by "1" to become "5". In step S168, the content of E0 is compared with "8". Here "8" means the maximum digit number in the second RAM 16. Since one digit is of 4-bit construction, the data corresponding to "1st" to "31st" may be stored with 8 digits. When judgment is made that $E0=8$ in step S168, the content of B4 and B5 is incremented by "1" in step S169, and the result is transferred to E1 and E2 for advancing the month by one. In step S170, "0" is stored in E0. When it is judged that "$E0=8$ in step S168, the program advances to step S171. In this instant, the content of B4 and B5 is transferred to E1 and E2 in advance. In step S171, the month data stored in E1 and E2 is compared with the month data of the last date of the specified period stored in D4 and D5. In this case, since the specified period is March 16 to March 29, "3" is stored in E1 and E2 and D4 and D5 so that the program advances to step S172. In step S172, the contents of the digits of the respective registers for the specified days of each month stored in E0 and C0 are compared with each other. In the case of the example, it is judged that the contents of E0 and C0 are not equal to each other. Then, the steps are repeated in the order of S165→S166→S167→S168→S171→S172→S165→A16-6→S167→S168→S171→S172 until E0=C0 for storing "1111" in the fourth to sixth digits of the register M3 for the specified days of March, as shown in FIG. 15(F). When it is judged that C0−A0=1 in step S163 or when it is judged that E0=C0 in step S172, the program advances to step S173. In step S173, a digit designation subroutine II to be described in detail with reference to FIG. 16 is executed.

In the digit designation subroutine II, the contents of A2 and C2 are corrected according to the contents of the digit A2 of the A register and the digit C2 of the C register. Next, the content "7" of C0 for designating the digit to which the last date of the period belongs is stored in AD0 and AD1, and the content "3" of D4 and D5 for designating the month to which the specified period belongs is stored in AD2 and AD3. Next, in step S175, the OR-addition of "1" (binary number "0001") stored in C2 and the content of the predetermined digit (7th digit of M3) of the second RAM 16 designated by the address register AD is performed. Next, in step S176, the content "3" of A0 for designating the digit to which the initial date of the period belongs is stored in AD0 and AD1, and the content "3" of B4 and B5 for designating the month to which the period belongs is stored in AD2 and AD3. Next, in step S177, "8" stored in A2 is OR-added to the content of the predetermined digit (third digit of M3) of the second RAM 16 designated by the address register AD. The obtained result is written in the third digit of M3 as shown in FIG. 15 (I). On the other hand, when it is judged that C0−A0=0 in step S163 and the initial date and the last date of the specified period are located in the same digit of the registers (M1 to M12 of the second RAM 16), the program advances to step S178. In step S178, the digit designation subroutine II to be described with reference to FIG. 16 is executed. Then, in step S179, the OR-addition of the contents A2 and C2 obtained as the output of the digit designation subroutine is executed and its result is stored in A2. Thereafter, the processing of steps S176 and S177 is executed.

The digit designation subroutine II will be described with reference to the flow chart of FIG. 16. According to this subroutine, the processing for storing the initial and final dates of the specified period is performed utilizing as the inputs the content of A2 storing the data to be written in the digit belonging to the initial date of the specified period, and the content of C2 for storing the data to be written in the digit belonging to the final date of the specified period. First, in step S181, a judgment is made as to whether or not the content of A2 is "8". When it is judged that the content of A2 is "8" in step S181, the program jumps to step S186. When it is judged that the content of A2 is not "8", the program advances to step S182. When it is judged that A2=1 in step S182, "15" (binary number −1111") is stored in A2. On the other hand, when it is judged that A2=2 in step S182, "14" (binary number "1110") is stored in A2 in step S184. When it is judged that A2=4 in step S182, "12" (binary number "1100") is stored in A2 in step S185. After executing steps S181, S183 and S185, the program advances to S186. In step 186, a judgment is made as to whether or not the content of C2 is "1". When the content of C2 is judged to be "1" in step S186, the processing is terminated. When it is judged that the content of C2 is not "1", the program advances to S187. When it is judged that C2=2 in step S187, "3" (binary number "0011") is stored in C2 in step S188. Further, when it is judged that C2=4 in step S187, "7" (binary number "0111") is stored in C2 in step S189. Further, when it is judged that C2=8 in step S190, "15" (binary number "1111") is stored in C1 in step S190. After executing steps S186, S188 and S190, the processing according to the flow chart is completed.

The display of the period specified as described above may be performed according to the operation shown in FIG. 8.

Figure 17:
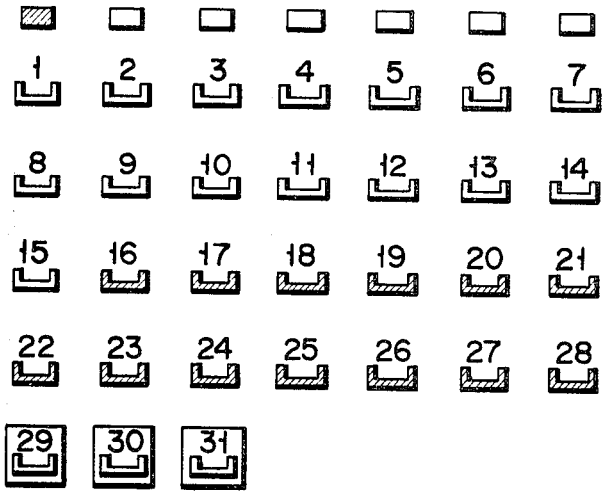
FIG. 17 shows the state when the data stored in the second RAM 16 in FIG. 1 is displayed according to the flow charts of FIGS. 14(A) and 14(B).
Figure 14A:
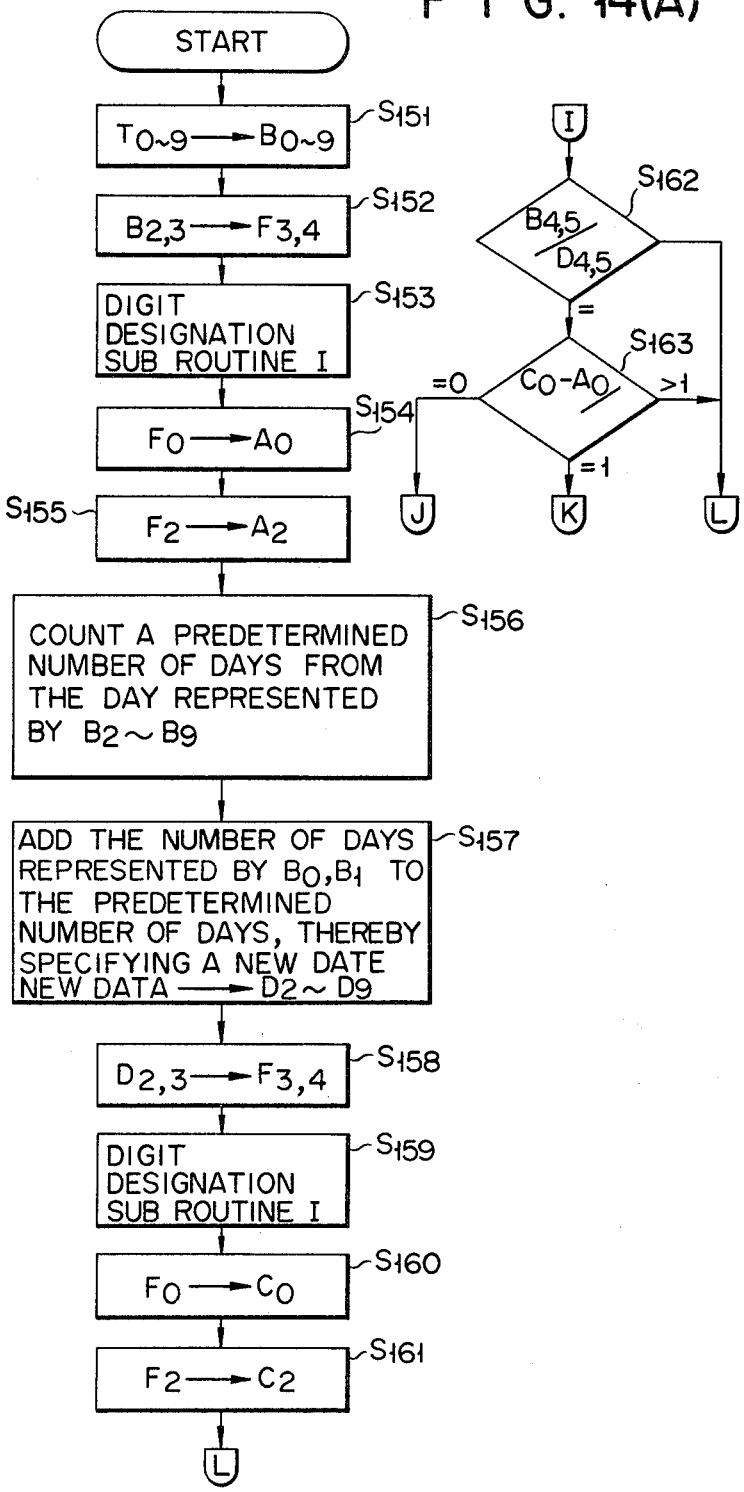
FIGS. 14(A) and 14(B) are flow charts for explaining the mode of operation of still another embodiment of the present invention.
Figure 14B:
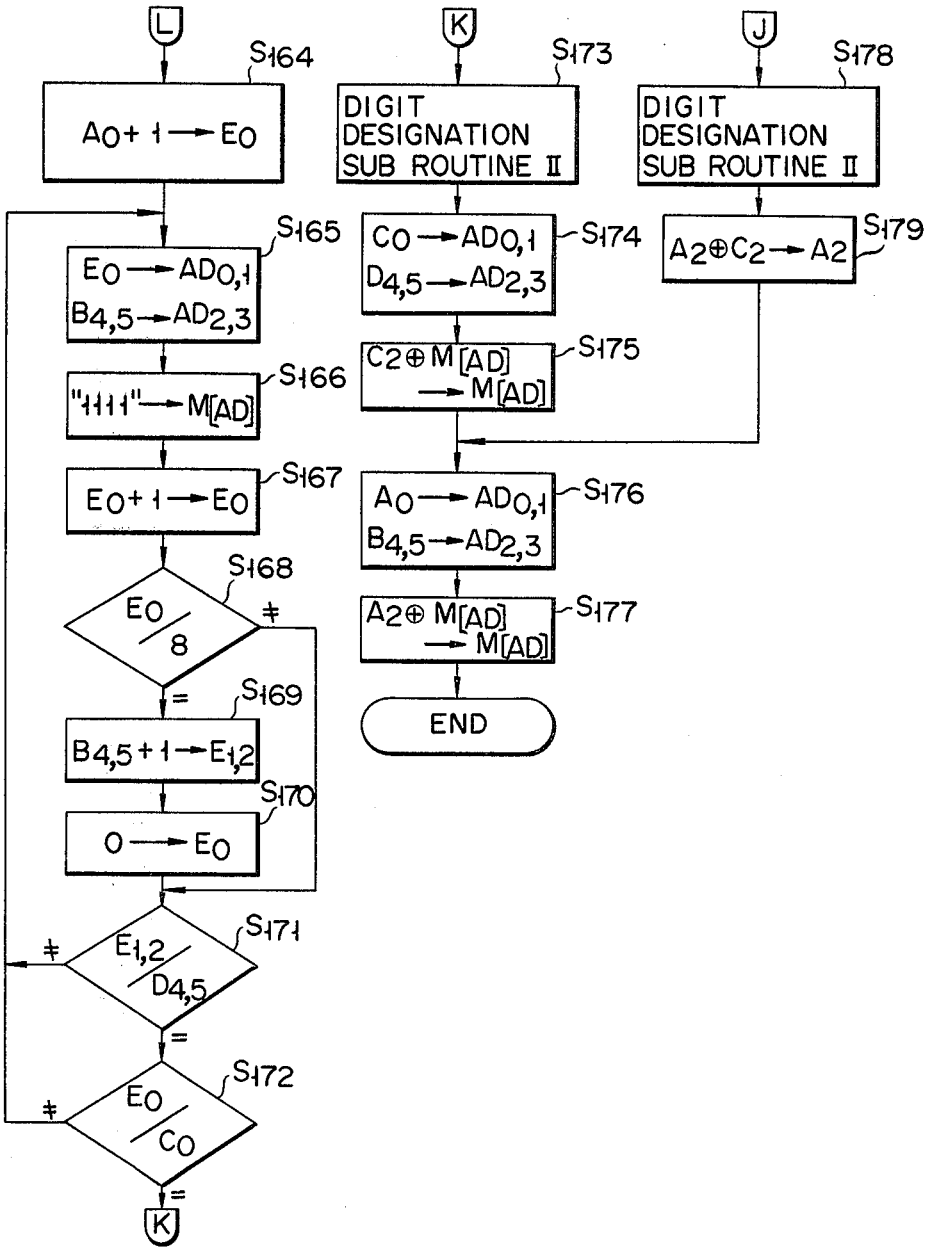

For example, for displaying the calendar of March of 1980, keys [1] [9] [8] [DATE] [3] [DATE] [CALE] are operated in sequence to perform the processing of the flow chart shown in FIG. 8, and the display as shown in FIG. 17 is performed.

Although the date data was sequentially calculated according to the initial date data and the data on the number of days in the above embodiment, the present invention is not limited to this; for example, the date data of the initial day and the data on the number of days may be stored instead.

It is to be understood that a period before the initial date can also be input.

What is claimed is:

1. A compact electronic device having a calendar function comprising:

key input means having keys for setting initial data as a reference for setting a plurality of specified dates, keys for inputting setting data for setting a plurality of specified dates based on said initial data, and at least one key for setting a plurality of dates according to said initial data and said setting data;

temporary memory means coupled to said key input means for storing said initial data and said setting data input by said key input means;

judging means for judging the form of the initial data and the setting data stored in said temporary memory means and for issuing a corresponding judging signal;

specified date calculating means for calculating a specified date according to the judging signal of said judging means;

date memory means coupled to said specified data calculating means for storing a plurality of dates calculated by said specified date calculating means; and visual display means for displaying a plurality of dates stored in said date memory means.

2. A compact electronic device according to claim 1, in which, when year data as said initial data and week and day data as said setting data are input by said key input means, said judging means judges that said initial data is year data and said setting data are week and day data, and issues a corresponding judging signal; and said specified date calculating means is responsive to the judging signal for calculating the date representing said data of said week in each month of said year, said week data representing particular week data in the month and said day data representing particular day data of the week, said specified date calculating means supplying the calculated specified date data to said date memory means.

3. A compact electronic device according to claim 2, wherein said date memory means is divided into at least 365 regions corresponding to a year; and wherein flags are stored in said regions corresponding to the dates calculated by said specified date calculating means.

4. A compact electronic device according to claim 2, wherein said date memory means is divided into at least 366 regions; and wherein flags are stored in said regions corresponding to the dates calculated by said specified date calculating means.

5. A compact electronic device according to claim 1, in which, when year and month data as said initial data and day data as said setting data are input by said key input means, said judging means judges that said initial data are year data and month data and setting data is day data, and issues a corresponding judging signal; and said specified date calculating means in responsive to said judging signal for calculating dates representing days in the month of said year, said day data representing day data in a week.

6. A compact electronic device according to claim 1, in which, when year and month data as said initial data and week data as said setting data are input by said key input means, said judging means judges that said initial data are year and month data and setting data are week data, and issues a corresponding judging signal; and said specified date calculating means is responsive to said judging signal for calculating a date representing a day in a week of the month of said year, said week data representing any particular week, said specified date calculating means supplying the calculated specified date data to said date memory means.

7. A compact electronic device according to claim 6 wherein said date memory means is divided into at least 31 areas corresponding to the days of a month; and wherein flags are stored in said areas corresponding to the dates calculated by said specified data calculating means.

8. A compact electronic device according to claim 1, in which, when year, month and day data as said initial data and data on a plurality of days as said setting data are input by said key input means, said judging means judges that said initial data are year, month and day data and said setting data are a plurality of days and issues a corresponding judging signal; and said specified date calculating means is responsive to said judging signal for calculating dates in a period corresponding to said plurality of days counted forward or backward with the particular day in the month of said year as a reference, said day data representing day data in the month of said year.

* * * * *

UNITED STATES PATENT AND TRADEMARK OFFICE

CERTIFICATE OF CORRECTION

PATENT NO. : 4,415,271

DATED : November 15, 1983

INVENTOR(S) : Hiromitsu MORI

It is certified that error appears in the above-identified patent and that said Letters Patent is hereby corrected as shown below:

Column 3, line 36, change "as shown in Fig. 4" to --as shown in Fig. 3--.

Signed and Sealed this

*Fifteenth* Day of *May 1984*

[SEAL]

*Attest:*

GERALD J. MOSSINGHOFF

*Attesting Officer*

*Commissioner of Patents and Trademarks*